US008722202B2

(12) United States Patent
Nagaraj et al.

(10) Patent No.: US 8,722,202 B2
(45) Date of Patent: May 13, 2014

(54) METHOD AND SYSTEM FOR ENHANCING HEAT TRANSFER OF TURBINE ENGINE COMPONENTS

(75) Inventors: Bangalore Aswatha Nagaraj, West Chester, OH (US); Marie Ann McMasters, Mason, OH (US)

(73) Assignee: General Electric Company, Schenectady, NY (US)

( * ) Notice: Subject to any disclaimer, the term of this patent is extended or adjusted under 35 U.S.C. 154(b) by 785 days.

(21) Appl. No.: 12/347,676

(22) Filed: Dec. 31, 2008

(65) Prior Publication Data

US 2010/0162715 A1 Jul. 1, 2010

(51) Int. Cl.

| | |
|---|---|
| ***B32B 18/00*** | (2006.01) |
| ***B32B 15/04*** | (2006.01) |
| ***C23C 16/06*** | (2006.01) |
| ***C23C 16/40*** | (2006.01) |
| *F23R 3/00* | (2006.01) |

(52) U.S. Cl.
USPC ..... 428/632; 428/680; 416/95

(58) Field of Classification Search
USPC ..... 428/680
See application file for complete search history.

(56) References Cited

U.S. PATENT DOCUMENTS

| | | | | |
|---|---|---|---|---|
| 5,348,446 | A * | 9/1994 | Lee et al. | 416/241 R |
| 5,975,852 | A | 11/1999 | Nagaraj et al. | |
| 6,393,828 | B1 | 5/2002 | Zhao et al. | |
| 6,403,165 | B1 * | 6/2002 | Grylls et al. | 427/456 |
| 6,461,746 | B1 | 10/2002 | Darolia et al. | |
| 6,465,090 | B1 | 10/2002 | Stowell et al. | |
| 6,534,907 | B1 | 3/2003 | Yoshida et al. | |
| 6,546,730 | B2 | 4/2003 | Johnson et al. | |
| 6,607,789 | B1 | 8/2003 | Rigney et al. | |
| 7,226,672 | B2 | 6/2007 | Litton et al. | |
| 2002/0108375 | A1 | 8/2002 | Johnson et al. | |
| 2003/0041923 | A1 * | 3/2003 | Kircher | 148/240 |
| 2004/0166355 | A1 | 8/2004 | Lee et al. | |
| 2005/0191516 | A1 * | 9/2005 | Nagaraj et al. | 428/650 |
| 2006/0168965 | A1 * | 8/2006 | Green et al. | 60/752 |
| 2007/0160859 | A1 | 7/2007 | Darolia et al. | |
| 2007/0207339 | A1 | 9/2007 | Zimmerman, Jr. et al. | |

FOREIGN PATENT DOCUMENTS

| | | | |
|---|---|---|---|
| EP | 0933797 | B1 | 7/2004 |
| EP | 1600518 | A2 | 11/2005 |
| EP | 1832669 | A1 | 9/2007 |
| EP | 1254967 | B1 | 11/2009 |
| JP | 2002-348681 | A | 12/2002 |
| JP | 2005-120478 | A | 5/2005 |
| JP | 2007-239101 | A | 9/2007 |

OTHER PUBLICATIONS

CN Office Action dated May 6, 2013 from corresponding CN Application No, 200910266855.8.
Search Report and Written Opinion from corresponding EP Application No. 09179370.3-2321 dated Jan. 11, 2013.

* cited by examiner

*Primary Examiner* — Gwendolyn Blackwell
*Assistant Examiner* — Lucas Wang
(74) *Attorney, Agent, or Firm* — McNees Wallace & Nurick LLC

(57) ABSTRACT

A method and system for enhancing the heat transfer of turbine engine components is disclosed that includes applying a metallic coating having a high thermal conductivity to the cold side of a turbine component to enhance heat transfer away from the component. The metallic coating may be roughened to improve heat transfer. The metal coating may be a Ni—Al bond coating having an aluminum content greater than about 50 weight percent.

20 Claims, 2 Drawing Sheets

METHOD AND SYSTEM FOR ENHANCING HEAT TRANSFER OF TURBINE ENGINE COMPONENTS

FIELD

The present disclosure is directed to a method and apparatus for improving the operation of turbine engine components. In particular, the present disclosure relates to turbine engine components having coatings that enhance the heat transfer.

BACKGROUND

The efficiency of turbine engines, for example gas turbines, is increased as the firing temperature, otherwise known as the working temperature, of the turbine increases. This increase in temperature results in at least some increase in power with the use of the same, if not less, fuel. Thus it is desirable to raise the firing temperature of a turbine to increase the efficiency.

However, as the firing temperature of gas turbines rises, the metal temperature of the combustion components, including but not limited to combustion liners and transition pieces otherwise know as ducts, increases. A combustion liner is incorporated into a turbine, and defines, in part with a transition piece or duct, an area for a flame to burn fuel. These components, as well as other components in the gas path environment, are subject to significant temperature extremes and degradation by oxidizing and corrosive environments.

Turbine combustion components, such as but not limited to, combustion liners, ducts, combustor deflectors, combustor centerbodies, nozzles and other structural hardware are often formed of heat resistant materials. The heat resistant materials are often coated with other heat resistant materials. For example, turbine components may be formed of wrought superalloys, such as but not limited to Hasteloy alloys, Nimonic alloys, Inconel alloys, and other similar alloys. These superalloys do not possess a desirable oxidation resistance at high temperatures, for example at temperatures greater than about 1500° F. Therefore, to reduce the turbine component temperatures and to provide oxidation and corrosion protection against hot combustion gasses, a heat resistant coating, such as but not limited to, a bond coating and a thermal barrier coating (TBC) are often applied to a surface of the turbine component exposed to the hot combustion gases, or otherwise known as a hot side surface. For example, a turbine component may include a thermally sprayed MCrAlY overlay coating as a bond coat and an air plasma sprayed (APS) zirconia-based ceramic as an insulating TBC. Often, the TBC is a zirconia stabilized with yttria ceramic.

Recently, ceramic top coat compositions with low thermal conductivity have increased temperature operation and strained the capability of applying only a thermal barrier coating to the hot side of turbine components. Current TBC systems have performed well in service in certain applications, however, improved coatings are sought to achieve greater temperature-thermal cycler time capability for longer service intervals or temperature capability.

What is needed is a coating system that enhances heat transfer from turbine components allowing turbine components to operate at higher system temperatures.

SUMMARY OF THE DISCLOSURE

In an exemplary embodiment, a. turbine combustion component is disclosed that includes a substrate having a hot side surface and a cold side surface, and an outside surface having a high thermal conductivity. The outside surface is either the cold side surface or a surface of a second bond coat.

In another exemplary embodiment, a. thermal barrier coating system for a substrate is disclosed that includes a first bond coat deposited on and in contact with a hot side surface of the substrate, a ceramic layer deposited on and in contact with the first bond coat, and an outside surface having a high thermal conductivity. The outside surface is either the cold side surface of the substrate or a surface of a second bond coat.

In another exemplary embodiment, a process of improving the heat transfer of a component is disclosed that includes providing a substrate having a first surface and a second surface, depositing a first bond coat on and in contact with the first surface, depositing a ceramic layer on and in contact with the first bond coat, and providing an outside surface having a high thermal conductivity. The outside surface is either the second surface or a surface of a second bond coat.

One advantage of the present disclosure includes the reduction of bond coat temperature.

Another advantage of the present disclosure includes increased component life.

Another advantage of the present disclosure is operating with lower flow of cooling air thereby improving engine efficiency.

Another advantage of the present disclosure is operating the TBC surface at a higher temperature thereby improving engine efficiency.

Another advantage of the present disclosure is the use of a lighter bond coating.

Other features and advantages of the present disclosure will be apparent from the following more detailed description of the preferred embodiment, taken in conjunction with the accompanying drawings which illustrate, by way of example, the principles of the disclosure.

BRIEF DESCRIPTION OF THE DRAWINGS

Wherever possible, the same reference numbers will be used throughout the drawings to represent the same parts.

DETAILED DESCRIPTION

In one embodiment, the present disclosure is generally applicable to metal components that are protected from a thermally hostile environment by a thermal barrier coating (TBC) system. Notable examples of such components include the high and low pressure turbine nozzles (vanes), shrouds, combustor liners, transition pieces, turbine frame and augmentor hardware of gas turbine engines. While this disclosure is particularly applicable to turbine engine components, the teachings of this disclosure are generally applicable to any component on which a thermal barrier may be used to thermally insulate the component from its environment.

Figure 1:
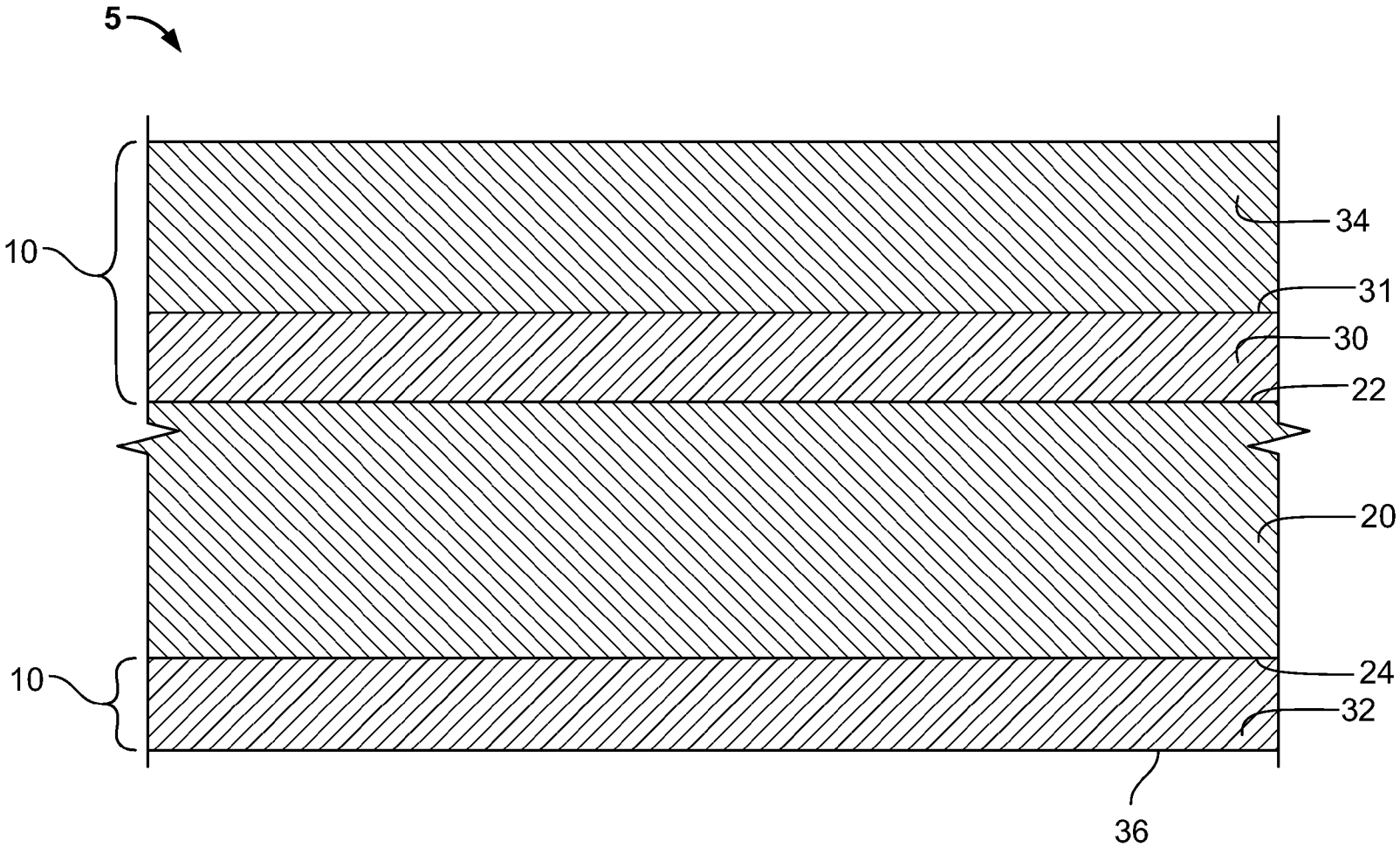
FIG. 1 shows a schematic view of a thermal barrier coating system having a bond coat in accordance with one exemplary embodiment according to the disclosure.

FIG. 1 shows a partial cross-section of a turbine engine component 5 having a TBC system (coating system) 10 in accordance with the present disclosure. The turbine engine component 5 includes a substrate 20 upon which the coating system 10 is deposited. The substrate 20 includes a first surface 22 and an opposing second surface 24. The first surface 22 is a hot side surface, or in other words, the surface facing the hot operational temperatures of the component 5. For example, the first surface 22 may be facing the flow of hot turbine gasses. The second side surface 24 is a cold side surface, or in other words, the surface facing away from the hot operational temperatures of the component 5. The second side surface 24 may be facing a cooling gas. In the cross-section shown in FIG. 1, the first surface 22 and the second surface 24 are parallel, however, in alternative arrangements, the substrate 20 may includes surfaces of any arrangement in conformance of the engine component 5.

In one embodiment, the substrate 20 is formed of any operable material. For example, the substrate 20 may be formed of any of a variety of metals or metal alloys, including those based on nickel, cobalt and/or iron alloys or superalloys. In one embodiment, substrate 20 is made of a nickel-base alloy, and in another embodiment substrate 20 is made of a nickel-base superalloy. A nickel-base superalloy may be strengthened by the precipitation of gamma prime or a related phase. In one example, the nickel-base superalloy has a composition, in weight percent, of from about 4 to about 20 percent cobalt, from about 1 to about 10 percent chromium, from about 5 to about 7 percent aluminum, from about 0 to about 2 percent molybdenum, from about 3 to about 8 percent tungsten, from about 4 to about 12 percent tantalum, from about 0 to about 2 percent titanium, from about 0 to about 8 percent rhenium, from about 0 to about 6 percent ruthenium, from about 0 to about 1 percent niobium, from about 0 to about 0.1 percent carbon, from about 0 to about 0.01 percent boron, from about 0 to about 0.1 percent yttrium, from about 0 to about 1.5 percent hafnium, balance nickel and incidental impurities. For example, a suitable nickel-base superalloy is available by the trade name Rene N5, which has a nominal composition by weight of 7.5% cobalt, 7% chromium, 1.5% molybdenum, 6.5% tantalum, 6.2% aluminum, 5% tungsten, 3% rhenium, 0.15% hafnium, 0.004% boron, and 0.05% carbon, and the balance nickel and minor impurities.

In accordance with one embodiment of the present disclosure, the coating system 10 includes a bond coat 30 over and in contact with the first side surface 22 and a metallic layer 32 over and in contact with the second side surface 24. The coating system 10 further includes a ceramic layer coating the first bond coat 30.

In one embodiment, the bond coat 30 and the metallic layer 32 may be a metal, metallic, intermetallic, metal alloy, composite and combinations thereof. The bond coat 30 and the metallic layer 32 may have the same or different compositions. In one embodiment, the bond coat 30 and the metallic layer 32 may be a NiAl. In one embodiment, the bond coat 30 is a NiAl, such as a predominantly beta NiAl phase, with limited alloying additions. The NiAl coating may have an aluminum content of from about 9 to about 12 weight percent, balance essentially nickel, and in another embodiment, have an aluminum content from about 18 to about 21 weight percent aluminum, balance essentially nickel. The bulk of the bond coating can consist of a dense layer of NiAl formed using a deposition process such as an air plasma spraying (APS), a wire arc spraying, a high velocity oxy fuel (HVOF) spray, and a low pressure plasma spray (LPPS) process. In one embodiment, the composition of the bond coat is not limited to NiAl bond coatings, and may be any metallic coating with an appropriate bonding and temperature capability. For example, the bond coat 30 may be a NiCrAlY coating. The bond coat 30 may have a thickness of about 100 to about 300 microns. The thickness of the bond coating can vary depending on the component and operational environment.

According to the disclosure, the metallic layer 32 is a high thermal conductivity metallic. In one embodiment, the metallic layer 32 has a thermal conductivity of between about 20 and about 60 BTU/hr ft ° F. In another embodiment, the metallic layer 32 has a high thermal conductivity of between about 30 and about 45 BTU/hrft° F. In yet still another embodiment, the metallic layer 32 has a thermal conductivity of between about 38 and about 42 BTU/hr ft ° F. In one embodiment, the metallic layer 32 may be a NiAl coating having a high thermal conductivity. For example, the metallic layer 32 may be a NiAl having an aluminum content of greater than about 50 weight percent. In one embodiment, the metallic layer 32 is deposited by a deposition method, such as by an air plasma spraying (APS), a wire arc spraying, a high velocity oxy fuel (HVOF) spray, and a low pressure plasma spray (LPPS) process. In one embodiment, the metallic layer 32 may have a thickness of from about 50 to about 600 microns, and more preferred from about 200 to about 400 microns. The thickness of the metallic layer 32 can vary depending on the component and operational environment.

Figure 2:
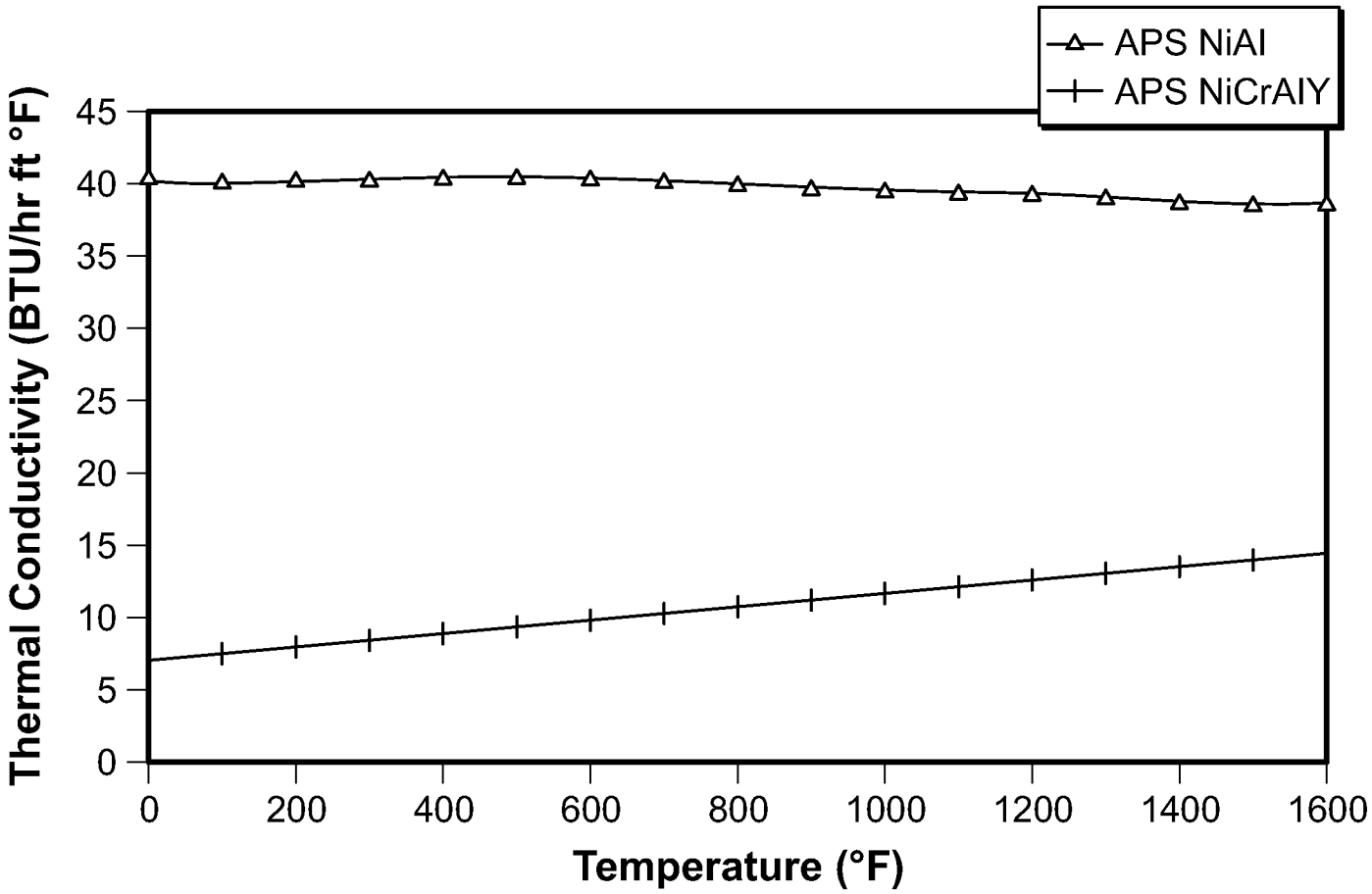
FIG. 2 shows a comparison of thermal conductivity for NiAl and NiCrAlY coatings.

The benefit of using a metallic layer 32 of a NiAl may be appreciated by a comparison of the thermal conductivities of air plasma spray (APS) NiAl and NiCrAlY coatings as shown in FIG. 2. As can be seen in FIG. 2, APS NiAl coatings have a high thermal conductivity over the temperature range of operation of turbine components, which increases heat transfer from the substrate 20.

In one embodiment, a low thermal conductivity metallic bond coat may be used as the first bond coat 30, and a high thermal conductivity metallic layer may be used as the metallic layer 32. For example, in one embodiment, the first bond coat 30 may be a NiCrAlY bond coat, and the metallic layer 32 may be a NiAl bond coat having a high thermal conductivity.

In one embodiment, the ceramic layer 34 may be a low thermal conductivity ceramic. For example, the low thermal conductivity ceramic may have a thermal conductivity of about 0.1 to 1.0 BTU/ft hr ° F., preferably in the range of 0.3 to 0.6 BTU/ft hr ° F. In one embodiment, the low thermal conductivity ceramic may be a mixture of zirconiun oxide, yttrium oxide, ytterbium oxide and nyodenium oxide. In another embodiment, the low thermal conductivity ceramic may be an yttria-stabilized zirconia (YSZ). In one embodiment, the ceramic layer 34 may be an YSZ having a composition of about 3 to about 10 weight percent yttria. In another embodiment, the ceramic layer 34 may be another ceramic material, such as yttria, nonstablilized zirconia, or zirconia stabilized by other oxides, such as magnesia (MgO), ceria ($CeO_2$), scandia ($Sc_2O_3$) or alumina ($Al_2O_3$). In yet other embodiments, the ceramic layer 34 may include one or more rare earth oxides such as, but not limited to, ytterbia, scandia, lanthanum oxide, neodymia, erbia and combinations thereof. In these yet other embodiments, the rare earth oxides may replace a portion or all of the yttria in the stabilized zirconia system. The ceramic layer 34 is deposited to a thickness that is sufficient to provide the required thermal protection for the underlying substrate, generally on the order of from about 75 to about 350 microns. As with prior art bond coatings, the first bond coat 30 includes an oxide surface layer (scale) 31 to which the ceramic layer 34 chemically bonds.

Referring again to FIG. 1, the metallic layer 32 has an outer surface 36. The outer surface 36 may be exposed to temperatures less than the temperatures to which the ceramic layer 34 is exposed. In one embodiment, the outer surface 36 is roughened between about 300 and 900 micro-inches to increase heat transfer. In another embodiment, the outer surface 36 is roughened between about 500 and 700 micro-inches. The roughness of the outer surface 36 may be formed during depositing of the metallic layer 32, and may be controlled by controlling deposition process parameters including, but not limited to, particle size and spray velocity. The roughening may be in the form of dimples and/or grooves. In another embodiment, the outer surface 36 may be roughed and/or additionally roughened after the deposition of the metallic layer 32 by, for example, a mechanical or chemical roughening process.

In another exemplary embodiment, the metallic layer 32 is not present and the outer surface 36 is the second side surface 24 of the substrate 20. In this embodiment, the substrate 20 may be formed of a high thermal conductivity metallic composition. In one embodiment, the substrate 20 may be a high thermal conductivity metal, metallic, intermetallic, metal alloy, composite and combinations thereof.

In one embodiment, the substrate may have a thermal conductivity of between about 20 and about 60 BTU/hr ft ° F. In another embodiment, the substrate 20 has a high thermal conductivity of between about 30 and about 45 BTU/hrft° F. In yet still another embodiment, the substrate 20 has a thermal conductivity of between about 38 and about 42 BTU/hr ft ° F. In one embodiment, the substrate 20 may be a NiAl having a high thermal conductivity. For example, the substrate 20 may be formed of a NiAl having an aluminum content of greater than about 50 weight percent aluminum. Further, the outer surface 36 may be roughened to increase heat transfer. In one embodiment, the outer surface 36 is roughened between about 300 and 900 micro-inches to increase heat transfer. In another embodiment, the outer surface 36 is roughened between about 500 and 700 micro-inches. The roughness of the outer surface 36 may be formed during the forming of the substrate 20. For example, the roughness of the outer surface 36 may be formed during casting of the substrate 20. The roughening may be in the form of dimples and/or grooves. In another embodiment, the outer surface 36 may be roughed or additionally roughened after the deposition of the second bond coat 32 by, for example, a mechanical or chemical roughening process While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A turbine combustion component, comprising:
- a substrate having a hot side surface and a cold side surface, the cold side surface being an outside surface;
- a bond coat overlying the substrate hot side surface; and
- a thermal barrier coating overlying the bond coat;
- wherein the cold side surface of the substrate has a metallic layer having a high thermal conductivity, the metallic layer:
  - having a surface roughness of between about 300 and about 900 micro-inches;
  - comprising a NiAl phase; and
  - having greater than about 50 weight percent aluminum.

2. The component of claim 1, wherein the high thermal conductivity is between about 20 and about 60 BTU/hr ft ° F.

3. The component of claim 1, wherein the substrate is a NiAl greater than about 50 weight percent aluminum having a substrate high thermal conductivity.

4. The component of claim 1, wherein the thermal barrier coating comprises a ceramic layer deposited on and in contact with the bond coat.

5. The component of claim 1, wherein the component further comprises:
- a bond coat deposited on and in contact with the hot side surface; and
- a ceramic layer deposited on and in contact with the bond coat;
- wherein the outside surface is a surface of the metallic layer deposited on and in contact with the cold side surface.

6. The component of claim 5, wherein the metallic layer has a thickness of between about 50 μm and about 600 μm.

7. The system of claim 1, wherein the roughness is applied in the form of dimples.

8. The system of claim 1, wherein the roughness is applied in the form of grooves.

9. The system of claim 1, wherein the outer surface is additionally roughened after the deposition of a second bond coat by a mechanical process.

10. The system of claim 1, wherein the outer surface is additionally roughened after the deposition of a second bond coat by a chemical roughening process.

11. A thermal barrier coating system for a substrate, comprising:
- a bond coat deposited on and in contact with a hot side surface of the substrate;
- a ceramic layer deposited on and in contact with the bond coat; and
- an outside surface having a high thermal conductivity greater than a thermal conductivity of the hot side surface;
- wherein the outside surface is a surface of a metallic layer, the metallic layer:
  - consisting essentially of a NiAl phase; and
  - comprising greater than about 50 weight percent aluminum; and
- wherein the outside surface has a roughness of between about 300 and about 900 micro-inches.

12. The system of claim 11, wherein the high thermal conductivity is between about 20 and about 60 BTU/hr ft ° F.

13. The system of claim 11, wherein the metallic layer has a thickness of about 50 μm to about 600 μm.

14. A turbine combustion component, comprising:
- a substrate having a hot side surface and a cold side surface;
- an outside surface having a high thermal conductivity greater than a thermal conductivity of the hot side surface;
- wherein:
  - the outside surface is a surface of a metallic layer, the metallic layer:
    - consisting essentially of a NiAl phase; and
    - comprising greater than about 50 weight percent aluminum;
  - the high thermal conductivity is between about 20 and about 60 BTU/hr ft ° F.; and
  - the outside surface has a roughness of between about 300 and about 900 micro-inches.

15. A method of improving the heat transfer of a component, comprising:
- providing a substrate having:
  - a hot side surface and a cold side surface;
  - a bond coat overlying the hot side surface; and
  - a thermal barrier coating overlying the bond coat; and
- depositing a metallic layer having a high thermal conductivity on and in contact with the cold side surface;
- wherein the metallic layer:

has a surface roughness of between about 300 and about 900 micro-inches;

comprises a NiAl phase; and has greater than about 50 weight percent aluminum.

16. The method of claim 15, wherein the high thermal conductivity is between about 20 and about 60 BTU/hr ft ° F.

17. The method of claim 15, wherein the thermal barrier coating comprises a ceramic layer deposited on and in contact with the bond coat.

18. The method of claim 15, wherein the metallic layer has a thickness of between about 50 μm and about 600 μm.

19. The method of claim 15, wherein the roughness is applied in the form of dimples.

20. The method of claim 15, wherein the roughness is applied in the form of grooves.

* * * * *